US011040530B2

(12) United States Patent
Anderson et al.

(10) Patent No.: US 11,040,530 B2
(45) Date of Patent: Jun. 22, 2021

(54) TEMPERATURE-BASED ACTUATOR EVALUATION

(71) Applicant: Hewlett-Packard Development Company, L.P., Spring, TX (US)

(72) Inventors: Daryl E. Anderson, Corvallis, OR (US); James A. Feinn, San Diego, CA (US); Eric Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/763,032

(22) PCT Filed: Jan. 24, 2018

(86) PCT No.: PCT/US2018/014953

§ 371 (c)(1),
(2) Date: May 11, 2020

(87) PCT Pub. No.: WO2019/147226

PCT Pub. Date: Aug. 1, 2019

(65) Prior Publication Data

US 2020/0384760 A1 Dec. 10, 2020

(51) Int. Cl.

| | |
|---|---|
| ***B41J 2/045*** | (2006.01) |
| ***B41J 2/14*** | (2006.01) |
| ***B41J 2/145*** | (2006.01) |

(52) U.S. Cl.

CPC ..... *B41J 2/04585* (2013.01); *B41J 2/04563* (2013.01); *B41J 2/145* (2013.01); *B41J 2/14427* (2013.01)

(58) Field of Classification Search

CPC ..... B41J 2/04585; B41J 2/04563; B41J 2/14427; B41J 2/145; B41J 2/175;

(Continued)

(56) References Cited

U.S. PATENT DOCUMENTS 4,724,336 A 2/1988 Ichikawa et al.
4,791,435 A 12/1988 Smith et al.

(Continued)

FOREIGN PATENT DOCUMENTS

KR 1020060060442 6/2006

OTHER PUBLICATIONS

MultiPASS C3000, Service Manual, 1997, Canon, 224 pgs.

*Primary Examiner* — Kristal Feggins
(74) *Attorney, Agent, or Firm* — Fabian VanCott

(57) ABSTRACT

In one example in accordance with the present disclosure, a fluidic system is described. The fluidic system includes a fluidic die. The fluidic die includes a substrate in which a number of fluid chambers are formed. Each fluid chamber includes a fluid actuator disposed within the fluid chamber. A number of actuator sensors are disposed on the substrate to output at least one value indicative of a sensed characteristic of fluid actuators. A number of substrate temperature sensors are also disposed on the substrate to sense a temperature for the substrate. An actuator evaluation device of the fluidic system determines a state of the fluid actuator based at least in part on the at least one value and at least one correction value associated with the temperature sensed by the number of substrate temperature sensors.

15 Claims, 7 Drawing Sheets

(58) Field of Classification Search
CPC .. B41J 29/393; B41J 2/04566; B41J 2/04568; B41J 2/0457; B41J 2/0459; B41J 2/04571; B41J 2/04573; B41J 2/04591
See application file for complete search history.

(56) References Cited

U.S. PATENT DOCUMENTS

| | | | | |
|---|---|---|---|---|
| 4,910,528 | A | 3/1990 | Firl et al. | |
| 5,736,995 | A | 4/1998 | Bohorquez et al. | |
| 6,634,735 | B1 * | 10/2003 | Silverbrook | B41J 2/04585 347/54 |
| 7,226,141 | B2 | 6/2007 | Asano et al. | |
| 7,918,540 | B2 | 4/2011 | Silverbrook | |
| 8,434,846 | B2 | 5/2013 | Tanaka | |
| 8,991,961 | B2 | 3/2015 | Kyoutani | |
| 9,862,187 | B1 | 1/2018 | Mu et al. | |
| 2006/0111807 | A1 | 5/2006 | Gothait et al. | |
| 2007/0291068 | A1 | 12/2007 | Aoki et al. | |
| 2009/0040258 | A1 | 2/2009 | Baek | |
| 2009/0179937 | A1 * | 7/2009 | Yamada | B41J 2/04581 347/17 |
| 2011/0074859 | A1 * | 3/2011 | Byun | B41J 3/543 347/16 |

* cited by examiner

TEMPERATURE-BASED ACTUATOR EVALUATION

BACKGROUND

A fluidic die is a component of a fluidic system. The fluidic die includes components that manipulate fluid flowing through the system. For example, a fluidic ejection die, which is an example of a fluidic die, includes a number of nozzles that eject fluid onto a surface. The fluidic die also includes non-ejecting actuators such as micro-recirculation pumps that move fluid through the fluidic die. Through these nozzles and pumps, fluid, such as ink and fusing agent among others, is ejected or moved. Over time, these nozzles and pumps can become clogged or otherwise inoperable. As a specific example, ink in a printing device can, over time, harden and crust. This can block the nozzle and interrupt the operation of subsequent ejection events. Other examples of issues affecting these actuators include fluid fusing on an ejecting element, particle contamination, surface puddling, and surface damage to die structures. These and other scenarios may adversely affect operations of the device in which the fluidic die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
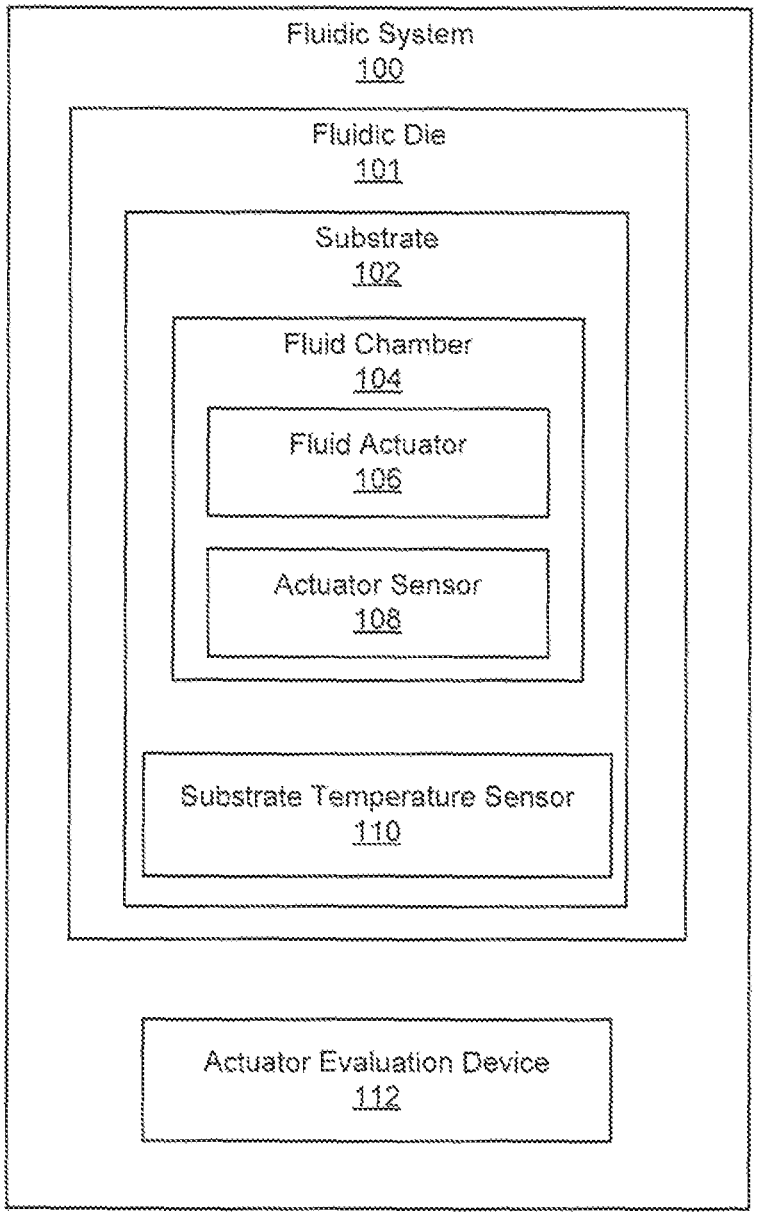
FIG. 1 is a block diagram of a fluidic system with temperature-based actuator evaluation, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid may be pumped, mixed, analyzed, ejected, etc. Such fluidic dies may include ejection dies, such as those found in printers, additive manufacturing distributor components, digital titration components, and/or other such devices with which volumes of fluid may be selectively and controllably ejected.

In a specific example, these fluidic systems are found in any number of printing devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluid systems dispense ink on a two-dimensional print medium such as paper. For example, during inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing, i.e., depositing fluid on a substrate, and in three-dimensional printing, i.e., depositing a fusing agent or other functional agent on a material base to form a three-dimensional printed product.

Each fluidic die includes a fluid actuator to eject/move fluid. A fluid actuator may be disposed in a nozzle, where the nozzle includes an ejection chamber and an opening in addition to the fluid actuator. The fluid actuator in this case may be referred to as an ejector that, upon actuation, causes ejection of a fluid drop via the nozzle opening.

Fluid actuators may also be pumps. For example, some fluidic dies include microfluidic channels. A microfluidic channel is a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Fluidic actuators may be disposed within these channels which, upon activation, may generate fluid displacement in the microfluidic channel.

Examples of fluid actuators include a piezoelectric membrane based actuator, a thermal resistor based actuator, an electrostatic membrane actuator, a mechanical/impact driven membrane actuator, a magneto-stricture drive actuator, or other such elements that may cause displacement of fluid responsive to electrical actuation. A fluidic die may include a plurality of fluid actuators, which may be referred to as an array of fluid actuators.

While such fluidic systems and dies undoubtedly have advanced the field of precise fluid delivery, some conditions impact their effectiveness. For example, the fluid actuators on a fluidic die are subject to many cycles of heating, drive bubble formation, drive bubble collapse, and fluid replenishment from a fluid reservoir. Over time, and depending on other operating conditions, the fluid actuators may become blocked or otherwise defective. For example, particulate matter, such as dried ink or powder build material, can block the opening. This particulate matter can adversely affect the formation and release of subsequent fluid. Other examples of scenarios that may impact the operation include a fusing of the fluid on the actuator element, surface puddling, and general damage to components within the fluid chamber. As the process of depositing fluid on a surface, or moving a fluid through a fluidic die is a precise operation, these blockages can have a deleterious effect on print quality or other operation of the system in which the fluidic die is disposed. If one of these actuators fails, and is continually operating following failure, then it may cause neighboring actuators to fail.

Accordingly, the present specification is directed to determining a state of a particular fluid actuator and/or identifying when a fluid actuator is blocked or otherwise malfunctioning. Following such an identification, appropriate measures such as actuator servicing and actuator replacement can be performed. Specifically, the present specification describes such components as being located on the die.

To perform such identification, a fluidic die of the present specification includes a number of actuator sensors disposed on the fluidic die itself, which sensors are paired with fluid actuators. In one example, the actuator sensors generate a voltage that is reflective of a characteristic of the fluid actuator. From this output voltage, an actuator evaluation device can compare the output voltage against a threshold value to evaluate the actuator to determine whether it is functioning as expected or not. In another example, multiple output voltages, taken at different times, can be evaluated in aggregate to as to produce a voltage profile. The voltage profile can be evaluated to determine functionality of the fluid actuator.

However, the output voltages are dependent upon the temperature of the substrate of the fluidic die and/or the temperature of the fluid which is in contact with the substrate. For example, it may be the case that as the substrate temperature rises, the viscosity of the fluid in contact with the substrate increases and that ion mobility of the fluid increases. The higher the ion mobility, the higher the electrical conductivity. As such, any charge is more readily moved from the plate. Accordingly, an output voltage may look "healthy" at one temperature, but may not look healthy when using the same evaluation criteria at a different die temperature.

Accordingly, a fluidic die having a higher temperature may have a lower output voltage as compared to a fluidic die having a lower temperature. Using one threshold value to evaluate output voltages of dies at different temperatures may yield spurious results. For example, the threshold value may be set to 2.5 V, with a higher voltage value indicating a faulty actuator and a voltage lower than the threshold indicating a properly functioning actuator. In this example, an output of 3 V from a fluidic die operating at 75 degrees Celsius may indicate a malfunctioning actuator. However, due to the effect of a decreased temperature of the fluidic die, an output of 3 V on a fluid die operating at 40 degrees Celsius may not be indicative of a faulty actuator. In this example, based on a comparison of the threshold 2.5 V with the 3 V, a system may incorrectly identify an actuator on the 75-degree die as being faulty, when that is in fact not the case. Accordingly, to do a proper assessment of the health of an actuator, the die temperature should be factored into the evaluation of the actuator. Moreover, the die temperature may be used to modify how the actuator evaluation is made. For example, the timing of sampling events may be modified based on the die temperature.

Accordingly, the present specification describes a system wherein the temperature of the fluidic die is accounted for during actuator evaluation. Specifically, a temperature of the substrate is determined and from this temperature correction values are applied to any threshold against which the output voltages are compared and/or the parameters which are used to evaluate a sensed voltage profile are adjusted.

Specifically, the present specification describes a fluidic system. The fluidic system includes a fluidic die. The fluidic die includes a substrate in which a number of fluid chambers are formed. Each fluid chamber includes a fluid actuator disposed therein. The fluidic die also includes a number of actuator sensors disposed on the substrate to output at least one value indicative of a sensed characteristic of a fluid actuator. A number of substrate temperature sensors are disposed on the substrate to sense a temperature for the substrate. An actuator evaluation device of the fluidic system determines a state of the fluid actuator based at least in part on the at least one value and at least one correction value associated with the temperature sensed by the number of substrate temperature sensors.

The present specification also describes a fluidic system that includes multiple fluidic dies. Each fluidic die includes a substrate in which a number of fluid chambers are formed. Each fluid chamber includes a fluid actuator disposed therein. The fluidic die also includes a number of actuator sensors disposed on the substrate to output at least one value indicative of a sensed characteristic of a fluid actuator. A number of substrate temperature sensors are disposed on the substrate to sense a temperature for the substrate. An actuator evaluation device determines a state of the fluid actuator based at least in part on the at least one value and at least one correction value associated with the temperature sensed by the number of substrate temperature sensors.

The present specification also describes a method for evaluating a fluid actuator. According to the method, a temperature of a substrate on which actuators of a fluid die are disposed is acquired, from at least one substrate temperature sensor. At least one voltage is generated at a fluid actuator sensor responsive to activation of a corresponding fluid actuator, Based on the temperature of the substrate, at least one correction value is determined for a threshold value against which the at least one voltage is compared. A state of the fluid actuator is evaluated at an actuator evaluation device based on a comparison of the at least one voltage and the at least one corrected threshold value.

In one example, using such a fluidic die 1) allows for actuator evaluation; 2) provides improved resolution times for malfunctioning actuators; and 3) provides more accurate assessment of actuator health by accounting for die substrate temperatures.

As used in the present specification and in the appended claims, the term "actuator" refers an ejecting actuator and/or a non-ejecting actuator. For example, an ejecting actuator operates to eject fluid from the fluid ejection die. A recirculation pump, which is an example of a non-ejecting actuator, moves fluid through the fluid slots, channels, and pathways within the fluid die.

Accordingly, as used in the present specification and in the appended claims, the term "nozzle" refers to an individual component of a fluid ejection die that dispenses fluid onto a surface. The nozzle includes at least an ejection chamber, an ejector actuator, and an opening.

Further, as used in the present specification and in the appended claims, the term "fluidic die" refers to a component of a fluid ejection system that includes a number of fluid actuators. A fluidic die includes fluidic ejection dies and non-ejecting fluidic dies.

Still further, as used in the present specification and in the appended claims, the term "substrate" refers to multiple layers of a fluidic die including a silicon substrate, metallic films, and thin films used to create fluidic structures such as channels, chambers, nozzles, filters, and the like.

As used in the present specification and in the appended claims, the term "a number of" or similar language is meant to be understood broadly as any positive number including 1 to infinity.

Turning now to the figures, FIG. 1 is a block diagram of a fluidic system (100) with temperature-based actuator evaluation, according to an example of the principles described herein. The fluidic system (100) includes a fluidic die (101). As described above, the fluidic die (101) is a part of the fluidic system (100) that houses components for ejecting fluid and/or transporting fluid along various pathways. The fluid that is ejected and moved throughout the fluidic die (101) can be of various types including ink, biochemical agents, and/or fusing agents. The fluid is moved and/or ejected via an array of fluid actuators (106). Any number of fluid actuators (106) may be formed on the fluidic die (101).

The fluidic die (101) includes a substrate (102). The substrate (102) refers to a surface in which various components of the fluidic die (101) are formed. The substrate (102) may include various layers including a silicon layer. Additional layers are disposed on the silicon layer. Other layers in the substrate (102) include a metallic layer where electrical connections are made and thin film layers wherein fluidic channels between the fluid chambers (104) and other fluidic components such as feed slots are formed.

The fluid chambers (104) formed in the substrate (102) include a fluid actuator (106) disposed therein, which fluid actuator (106) works to eject fluid from, or move fluid throughout, the fluidic die (101). The fluid chambers (104) and fluid actuators (106) may be of varying types. For example, the fluid chamber (104) may be an ejection chamber wherein fluid is expelled from the fluidic die (101) onto a surface for example such as paper or a 3D build bed. In this example, the fluid actuator (106) may be an ejector that ejects fluid through an opening of the fluid chamber (104).

In another example, the fluid chamber (104) is a channel through which fluid flows. That is, the fluidic die (101) may include an array of microfluidic channels. Each microfluidic channel includes a fluid actuator (106) that is a fluid pump. In this example, the fluid pump, when activated, displaces fluid within the microfluidic channel. While the present specification may make reference to particular types of fluid actuators (106), the fluidic die (101) may include any number and type of fluid actuators (104).

These fluid actuators (106) may rely on various mechanisms to eject/move fluid. For example, an ejector may be a firing resistor. The firing resistor heats up in response to an applied voltage. As the firing resistor heats up, a portion of the fluid in an ejection chamber vaporizes to generate a bubble. This bubble pushes fluid out an opening of the fluid chamber and onto a print medium. As the vaporized fluid bubble collapses, fluid is drawn into the ejection chamber from a passage that connects the fluid chamber (104) to a fluid feed slot in the fluidic die (101), and the process repeats. In this example, the fluidic die (101) may be a thermal inkjet (TIJ) fluidic die (101).

In another example, the fluid actuator (106) may be a piezoelectric device. As a voltage is applied, the piezoelectric device changes shape which generates a pressure pulse in the fluid chamber (104) that pushes the fluid through the chamber. In this example, the fluidic die (101) may be a piezoelectric inkjet (PIJ) fluidic die (101).

Figure 2:
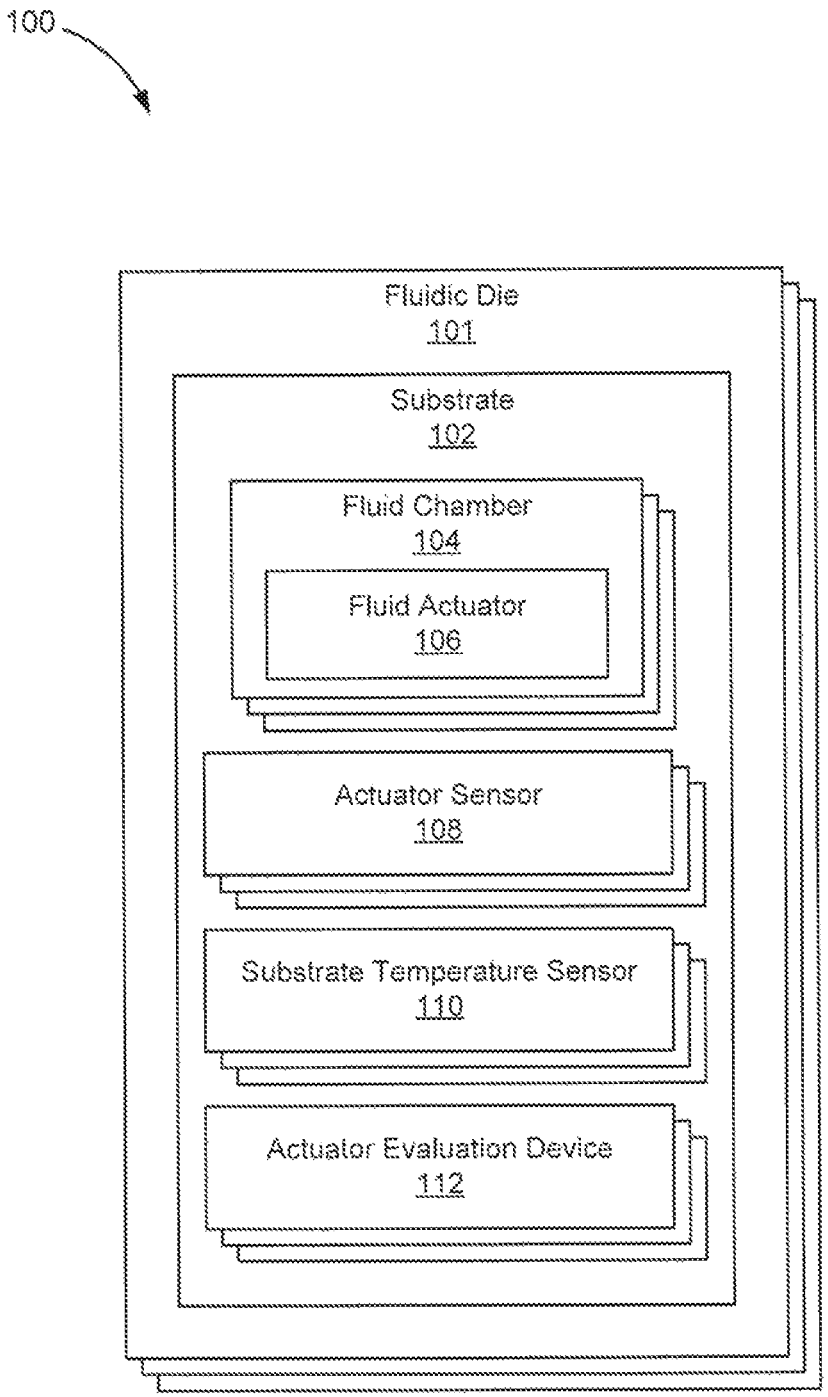
FIG. 2 is a block diagram of a fluidic system with temperature-based actuator evaluation, according to an example of the principles described herein.

The fluidic die (101) also includes a number of actuator sensors (108) disposed on the fluidic die (10'). In some cases there may be one actuator sensor (108) as depicted in FIG. 1, in other examples there may be multiple actuator sensors (108) as depicted in FIG. 2. Additionally, in some cases, as depicted in FIG. 1, the actuator sensor (108) is disposed within the fluid chamber (104). In other examples, as depicted in FIG. 2, the actuator sensor(s) (108) may be on the substrate (102) but not within a fluid chamber (104).

The actuator sensors (108) sense a characteristic of a corresponding fluid actuator (106). For example, the actuator sensors (108) may measure an impedance near a fluid actuator (106). In a specific example, the actuator sensors (108) are drive bubble detectors that detect the presence of a drive bubble within a fluid chamber (104).

In this example, a drive bubble is generated by a fluid actuator (106) to move fluid in, or eject fluid from, the fluid chamber (104). Specifically, in thermal inkjet printing, a thermal ejector heats up to vaporize a portion of fluid in a fluid chamber (104). As the bubble expands, it forces fluid out of the fluid chamber (104). As the bubble collapses, a negative pressure within the fluid chamber (104) draws fluid from the fluid source, such as a fluid feed slot or fluid feed holes, to the fluidic die (101). Sensing the proper formation and collapse of such a drive bubble can be used to evaluate whether a particular fluid actuator (106) is operating as expected. That is, a blockage in the fluid chamber (104) will affect the formation of the drive bubble. If a drive bubble has not formed as expected, it can be determined that the nozzle is blocked and/or not working in the intended manner.

The presence of a drive bubble can be detected by measuring impedance values within the fluid chamber (104). That is, as the vapor that makes up the drive bubble has a different conductivity than the fluid that otherwise is disposed within the chamber, when a drive bubble exists in the ejection chamber, a different impedance value will be measured. Accordingly, a drive bubble detection device measures this impedance and outputs a corresponding voltage. As will be described below, this output can be used to determine whether a drive bubble is properly forming and therefore determine whether the corresponding ejector or pump is in a functioning or malfunctioning state.

Such impedance measurements can be done at different times. In one example, a fluid actuator (106) is evaluated by measuring a voltage at a "peak" time, when it is expected that mostly vapor fills the fluid chamber (104) and at a "re-fill" time, when it is expected that fluid has returned to fill the fluid chamber (104). The measured voltages are indicative of a measured impedance. The difference between the two values is then evaluated. If the difference between the two values exceeds a threshold, then the fluid actuator (106) is considered functional. If the difference is below the threshold, the fluid actuator (106) is considered compromised.

Structurally the actuator sensor (108) may include a single electrically conductive plate, such as a tantalum plate, which can detect an impedance of whatever medium is within the fluid chamber (104). Specifically, each actuator sensor (108) measures an impedance of the medium within the fluid chamber (104), which impedance measurement, as described above, can indicate whether a drive bubble is properly forming in the fluid chamber (104). The actuator sensor (108) then outputs voltage values indicative of a state, i.e., drive bubble formed or not, of the corresponding fluid actuator (106). This output can be compared against threshold values to determine whether the fluid actuator (106) is malfunctioning or otherwise inoperable.

This comparison can be used to trigger subsequent fluid actuator (106) management operations. While description has been provided of an impedance measurement, other characteristics may be measured to determine the characteristic of the corresponding fluid actuator (106).

The fluidic die (101) also includes a number of substrate temperature sensors (110) disposed on the substrate (102) to sense a temperature for the substrate (102). A substrate temperature sensor (110) may take various forms. For example, a substrate temperature sensor (110) may be a thermal sense resistor (TSR) that spans the length of the fluidic die (101) and takes an aggregate temperature of the substrate (102). In this example, the number of substrate temperature sensors (110) is less than the number of fluid chambers (104).

In another example, the number of substrate temperature sensors (110) may be the same as the number of fluid chambers (104). For example, a diode thermal sensor may be placed near, or in, the fluid chamber (104). In other words, in this example, each fluid chamber (104) may have a unique diode thermal substrate temperature sensor (110). In another example, multiple fluid chambers (104) may be paired with a single diode thermal substrate temperature sensor (110).

The fluid system (100) also includes an actuator evaluation device (112). In some examples as depicted in FIG. 1, the actuator evaluation device (112) is off die. In other examples as depicted in FIG. 2, the actuator evaluation device (112) may be on the fluidic die (101).

The actuator evaluation device (112) evaluates a state of any fluid actuator (106) and generates an output indicative of the fluid actuator (106) state. In the present system, the output accounts for a temperature of the fluidic die (101). Specifically, the actuator evaluation device (112) evaluates a fluid actuator (106) based at least on 1) outputs of the actuator sensor (108), which outputs are indicative of a sensed characteristic and 2) at least one correction value associated with the temperature sensed by the number of substrate temperature sensors (110). For example, an actuator sensor (108) may output multiple values that correspond to impedance measurements within a fluid chamber (104) at different points in time. The difference between these values can be compared against a difference threshold that has a correction value applied to it. The corrected threshold delineates between a proper bubble formation and a faulty bubble formation.

As a specific example, a voltage difference is calculated between measurements taken at a peak time and a refill time, a voltage difference that is lower than a corrected threshold may indicate improper bubble formation and collapse. Accordingly, a voltage difference greater than the corrected threshold may indicate proper bubble formation and collapse. While a specific relationship, i.e., low voltage difference indicating improper bubble formation, high voltage difference indicating proper bubble formation, has been described, any desired relationship can be implemented in accordance with the principles described herein.

The correction values that are applied to the thresholds against which the voltages are compared is based on the temperature. As described above, the temperature of the substrate (102) may change the temperature of the fluid. A change in the temperature of the fluid may change the conductivity of the fluid such that output values of an actuator sensor (108) are affected by the temperature. The correction values applied to the thresholds account for such a dependency. Accordingly, the correction values adjust the threshold values up or down, whether the threshold value is a single value, i.e., a peak value, or a difference between multiple values.

In some examples, the actuator evaluation device (112) may determine multiple correction values. One correction value may be applied to the peak threshold value and another correction value applied to the refill threshold value. For example, as described above the actuator sensor (108) may perform two impedance measurements, one at a peak time and another at a refill time. In this example, the different correction values may independently adjust a peak threshold value and a refill threshold value, against which the values corresponding to the impedances are compared.

The correction values may be determined via an adjustment calculator. The adjustment calculator may take many forms including a lookup table and linear and/or non-linear operators. For example, upon design of a device in which the fluidic die (101) is included, measurements may be taken indicating what adjustments should be made for a given temperature. The different adjustments, and a mapping to the given temperatures, may be stored, during manufacturing, in a look-up table that is stored on the fluidic die (101) or elsewhere. Then during operation, when a given temperature is sensed by the substrate temperature sensor(s) (110), the lookup table is referenced, a temperature identified, and an appropriate adjustment to the threshold value(s) determined.

In another example, scaling factors may be determined. For example, the adjustment values may be represented as a linear representation, such as adjustment factor=temperature times X plus B where X and B are fixed, stored values. While specific reference is made to linear representations, other representations such as quadratic may also be used. Similarly in this example, during operation, when a given temperature is sensed by the substrate temperature sensor(s) (110), the values can be plugged into the representation, a temperature identified, and an appropriate adjustment(s) to the threshold value(s) determined.

In some examples, the correction values are unique to the fluidic die (101). That is, the correction values may be based on an architecture of a particular fluidic die (101) and the fluid in that die among other factors. In this example, determination of the correction valued may be determined during initialization of the device in which the fluidic die (101) is stored.

In some examples, fluid actuator evaluation occurs during a non-imaging period of operation. That is, when the fluidic die (101) is in a testing mode, the array of fluid actuators (106) are actuating, but do not form part of an image. By comparison, when the fluidic die (101) is in a printing mode, the array of fluid actuators (106) are actuating to form part of an image. That is, dedicated actuation events are executed during actuator evaluation.

In other examples, fluid actuator evaluation occurs during a printing operation. That is, when the fluidic die (101) is in a printing mode, the array of fluid actuators (106) are actuated and evaluated, and form part of an image.

FIG. 2 is a block diagram of a fluidic system (100) with temperature-based actuator evaluation, according to an example of the principles described herein. In this example, the fluidic system (100) includes multiple fluidic dies (101). Each fluidic die (101) may include a substrate (102) on which fluid chambers (104) are formed. In some examples, each substrate (102) includes multiple fluid chambers (104), each fluid chamber (104) having a corresponding fluid actuator (106). Each fluidic die (101) may also include multiple actuator sensors (108), which may or may not be uniquely paired with corresponding fluid chambers (104). That is, in some examples, each actuator sensor (108) of the number of actuator sensors (108) may be coupled to a respective fluid actuator (106). In other examples, the number of actuator sensors (108) may be different than the number of fluid actuators (106). Moreover, as depicted in FIG. 2, the actuator sensors (108) may be outside of corresponding fluid chambers (104).

Also, as described above, the fluidic die (101) may include any number of actuator evaluation devices (112). As depicted in FIG. 2, in some examples the actuator evaluation device (112) may be on the fluidic die (101) itself. In some examples, each fluid actuator (106) may be uniquely paired with an actuator evaluation device (112) and in other examples, multiple fluid actuators (106), i.e., a primitive, may be grouped with a single actuator evaluation device (112).

Each fluidic die (101) may include multiple substrate temperature sensors (110), which number may be less than, equal to, or greater than the number of fluid chambers (104).

Figure 3:
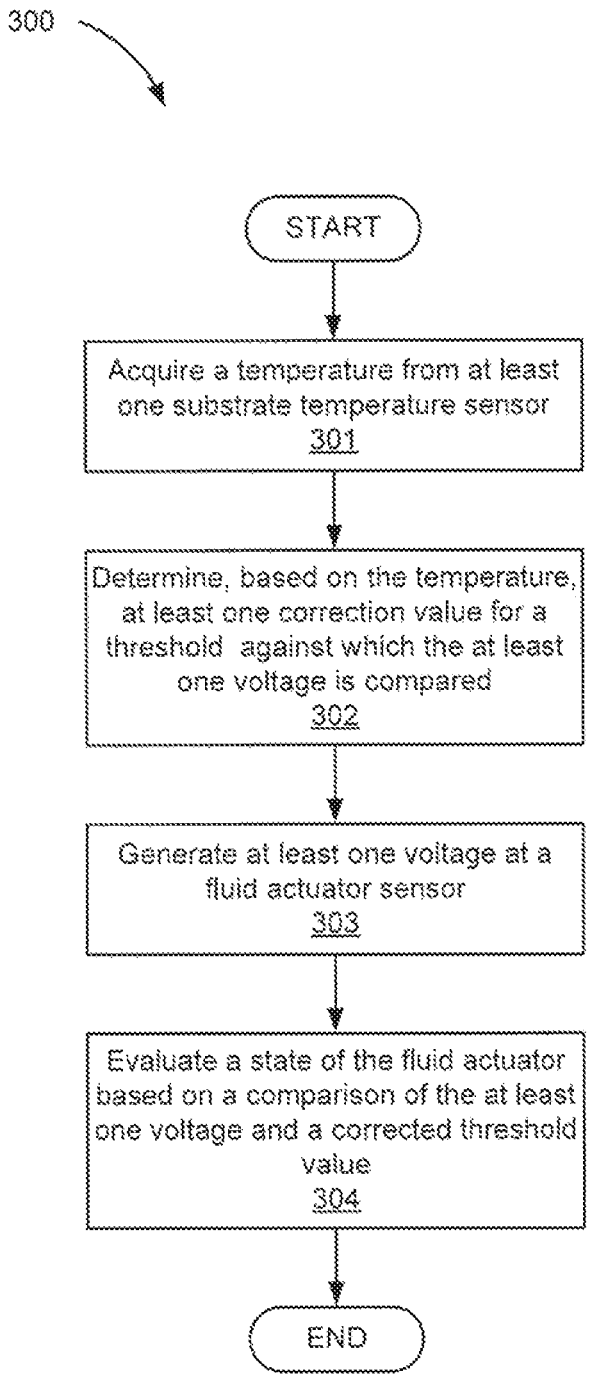
FIG. 3 is a flow chart of a method for evaluating an actuator on a fluidic die based on a temperature of a substrate, according to an example of the principles described herein.

FIG. 3 is a flow chart of a method (300) for evaluating a fluid actuator (FIG. 1, 106) on a fluidic die (FIG. 1, 101) based on a temperature of a substrate (FIG. 1, 102), according to an example of the principles described herein.

According to the method, a temperature of a substrate (FIG. 1, 102) is acquired (block 301), for example by the substrate temperature sensors (FIG. 1, 110). That is, each of the substrate temperature sensors (FIG. 1, 100) detects a temperature of the substrate (FIG. 1, 102) in which fluid chambers (FIG. 1, 104) are formed. Such a temperature may be averaged from multiple substrate temperature sensors (FIG. 1, 110) that are paired with fluid chambers (FIG. 1, 104) or from multiple substrate temperature sensors (FIG. 1, 110) which are fewer in number than the number of fluid chambers (FIG. 1, 104).

Based on the temperature acquired (block 301), at least one correction value is determined (block 302) for the threshold values against which the voltages are compared. That is, as described above, a mapping may be made between a temperature and corrected threshold value(s). The corrected threshold value(s) being value(s) against which voltages output by the actuator sensors (FIG. 1, 108) are compared to determine a state, i.e., health, of a fluid actuator (FIG. 1, 106). In one example, such a determination may include consulting an adjustment calculator which may include a look-up table or a linear/non-linear representation. For example, a look-up table, either determined empirically during initialization of the printing device or during manufacturing of the printing device, may indicate certain adjustments to the peak threshold, refill threshold, or differences therebetween, to be made for a given temperature. Accordingly, determining (block 302) the correction for the threshold value may include locating the sensed temperature in the look-up table, and selecting the correction values mapped to that temperature.

At least one voltage is then generated (block 303) at an actuator sensor (FIG. 1, 108). This at least one voltage corresponds to the activation of a particular fluid actuator. That is, an electrical impulse signal is sent to a fluid actuator (FIG. 1, 106) to generate a drive bubble. A controller, or other off-die device, sends an electrical impulse that initiates an activation event. For a non-ejecting actuator, such as a recirculation pump, the activation pulse may activate a component to move fluid throughout the fluid channels and fluid slots within the fluidic die (FIG. 1, 101). In a nozzle, the activation pulse may be a firing pulse that causes the ejector to eject fluid from the ejection chamber.

To generate (block 303) the voltage values, a current is passed to the single electrically conductive plate of the actuator sensor (FIG. 1, 108), and from the plate, into the fluid or fluid vapor. As this current is passed to the actuator sensor (FIG. 1, 108) plate and from the plate, into the fluid or fluid vapor, a voltage is measured and an impedance determined.

In some examples, multiple voltage values are generated (block 302). That is, as described above, a first voltage value may be generated during a "peak" time and a second voltage value may be generated during a "refill" time. These voltages together may form a profile against which a threshold is compared.

A state of the fluid actuator (FIG. 1, 106) is then evaluated (block 304) based on a comparison of the voltages with the corrected threshold values. In this example, the corrected threshold value may be selected to clearly indicate a blocked, or otherwise malfunctioning, fluid actuator (FIG. 1, 106). That is, the corrected threshold value may reflect differences between a peak and refill voltage expected during proper drive bubble formation. Accordingly, the threshold difference is determined such that a voltage difference lower than the threshold indicates improper bubble formation, and a voltage difference higher than the threshold indicates proper bubble formation. As such, the corrected threshold value, accounts for any increases or decreases in electrical conductivity resultant from differences in temperature, by adjusting the threshold against which measured voltages are compared.

Figure 4:
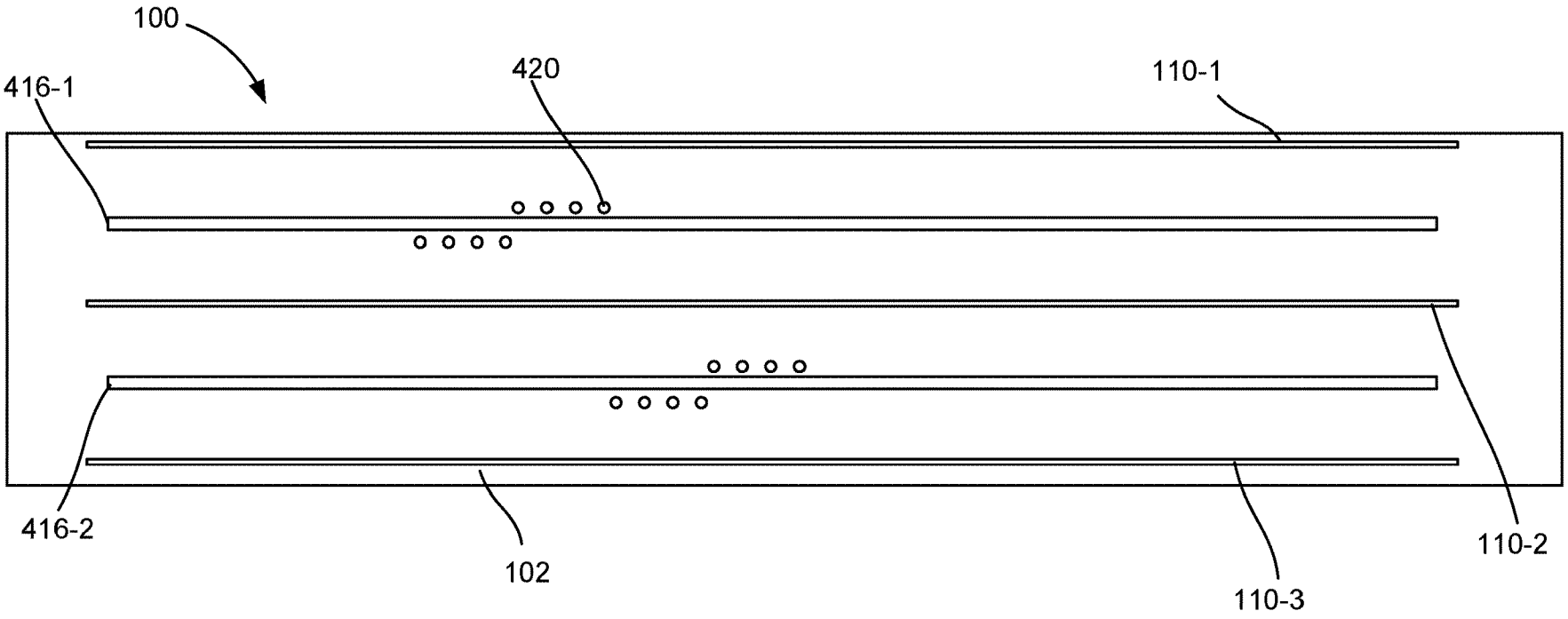
FIG. 4 is a diagram of a fluidic ejection die with temperature-based actuator evaluation, according to an example of the principles described herein.

FIG. 4 is a diagram of a fluidic die (101) with temperature-based actuator evaluation, according to an example of the principles described herein. As described above, the fluidic die (101) includes a substrate (102) on which various components are disposed. The fluidic die (101) also includes fluid feed slots (416-1, 416-2) that deliver fluid to the ejection chambers (420), which is an example of a fluid chamber (FIG. 1, 104), For simplicity, a few ejection chambers (420) are depicted, but the fluidic die (101) may include ejection chambers (420) that run the length of the fluid feed slots (416). While FIG. 4 depicts a fluid feed slots (416), other fluid delivery mechanisms may be used such as an array of fluid feed holes.

To eject fluid, each ejection chamber (420) includes a number of components. For example, an ejection chamber (420) includes an opening through which the amount of fluid is ejected, and a fluid actuator (FIG. 1, 106) disposed within the ejection chamber (420), to eject the amount of fluid through the opening. FIG. 4 also depicts substrate temperature sensors (110) in the form of thermal sense resistors (TSRs) (110-1, 110-2, 110-3) that run the length of the fluid feed slots (416).

Figure 5:
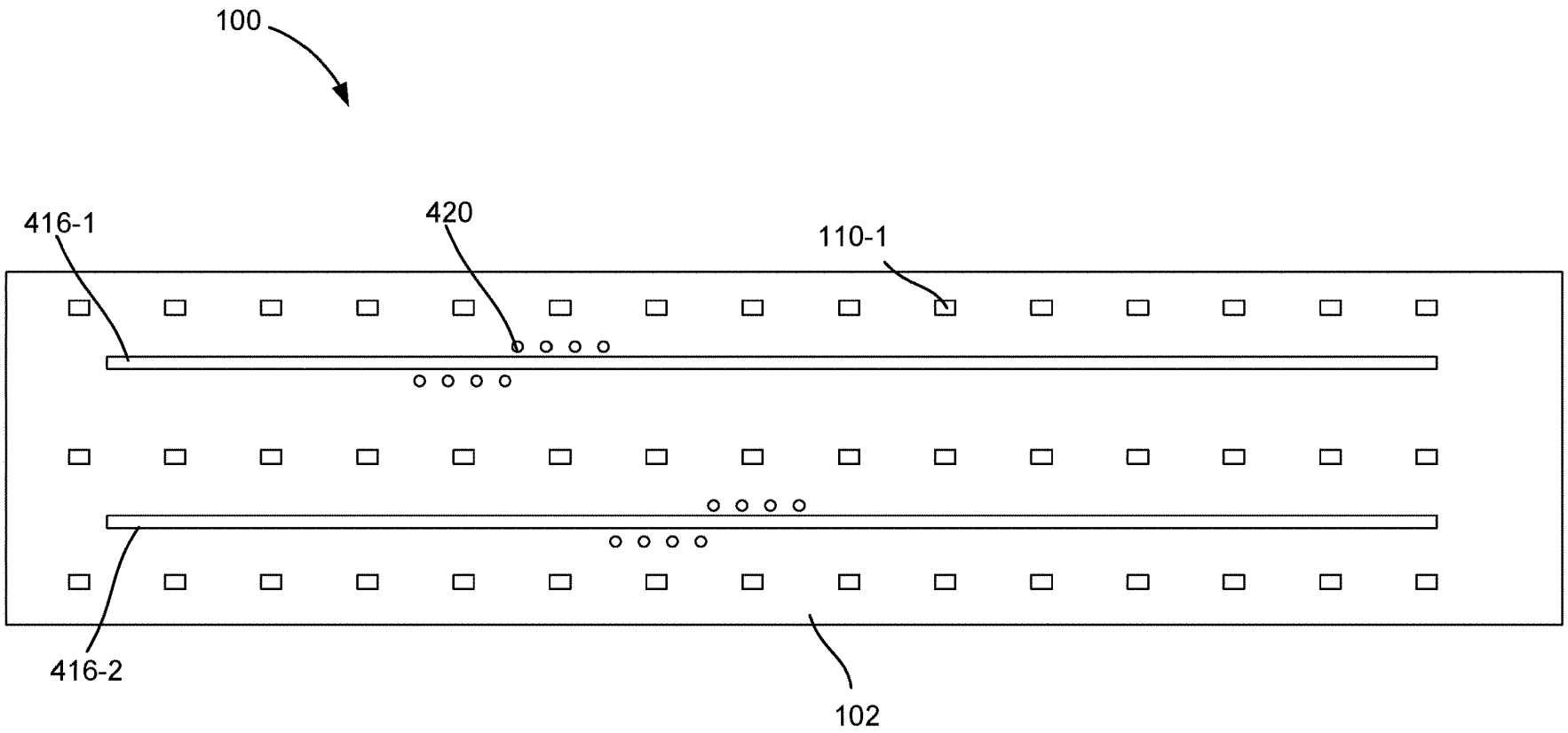
FIG. 5 is a diagram of a fluidic ejection die with temperature-based actuator evaluation, according to an example of the principles described herein.

FIG. 5 is a diagram of a fluidic die (101) with temperature-based actuator evaluation, according to an example of the principles described herein. As described above, the fluidic die (101) includes a substrate (102) on which various components are disposed. The fluidic die (101) also includes fluid feed slots (416-1, 416-2) that deliver fluid to the ejection chambers (420), which is an example of a fluid chamber (FIG. 1, 104). For simplicity, a few ejection chambers (420) are depicted, but the fluidic die (101) may include ejection chambers (420) that run the length of the fluid feed slots (416). FIG. 5 also depicts substrate temperature sensors (110) in the form of sense diodes that are spaced more closely than the thermal sense resistors depicted in FIG. 4. While FIGS. 4 and 5 depict particular arrangements and types of substrate temperature sensors (110) other types of substrate temperature sensors (110) may be implemented in accordance with the principles described herein.

Figure 6:
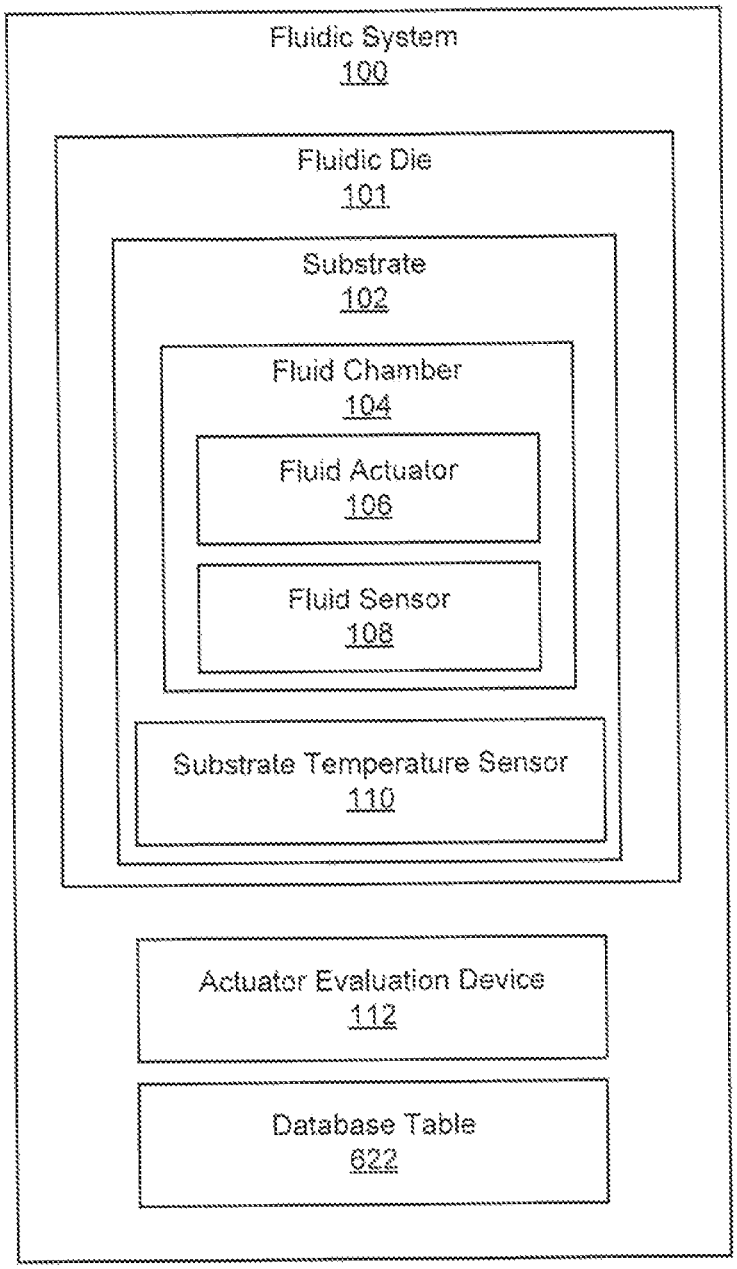
FIG. 6 is a block diagram of a fluidic system with temperature-based actuator evaluation, according to an example of the principles described herein.

FIG. 6 is a block diagram of a fluidic system (100) with temperature-based actuator evaluation, according to an example of the principles described herein. The fluidic system (100) includes the fluidic die (101) with the corresponding substrate (102), fluid chamber (104), fluid actuator (106), actuator sensor (108), and substrate temperature sensor (110). The fluidic system (100) also includes an actuator evaluation device (112) similar to those described above.

In this example, the fluidic system (100) also includes a database table (622) that includes an adjustment calculator such as 1) a look-up table that contains the mapping between temperatures and corresponding correction values or 2) a linear/non-linear relationship from which such correction values can be calculated. That is, the different threshold adjustments, and a mapping to the given temperatures, may be stored in a database table (622) that is stored on the fluidic die (101) or elsewhere. Then during operation, when a given temperature is sensed by the substrate temperature sensor(s) (110), the database table (622) is referenced, a temperature identified, and an appropriate adjustment to the threshold value(s) determined.

Figure 7:
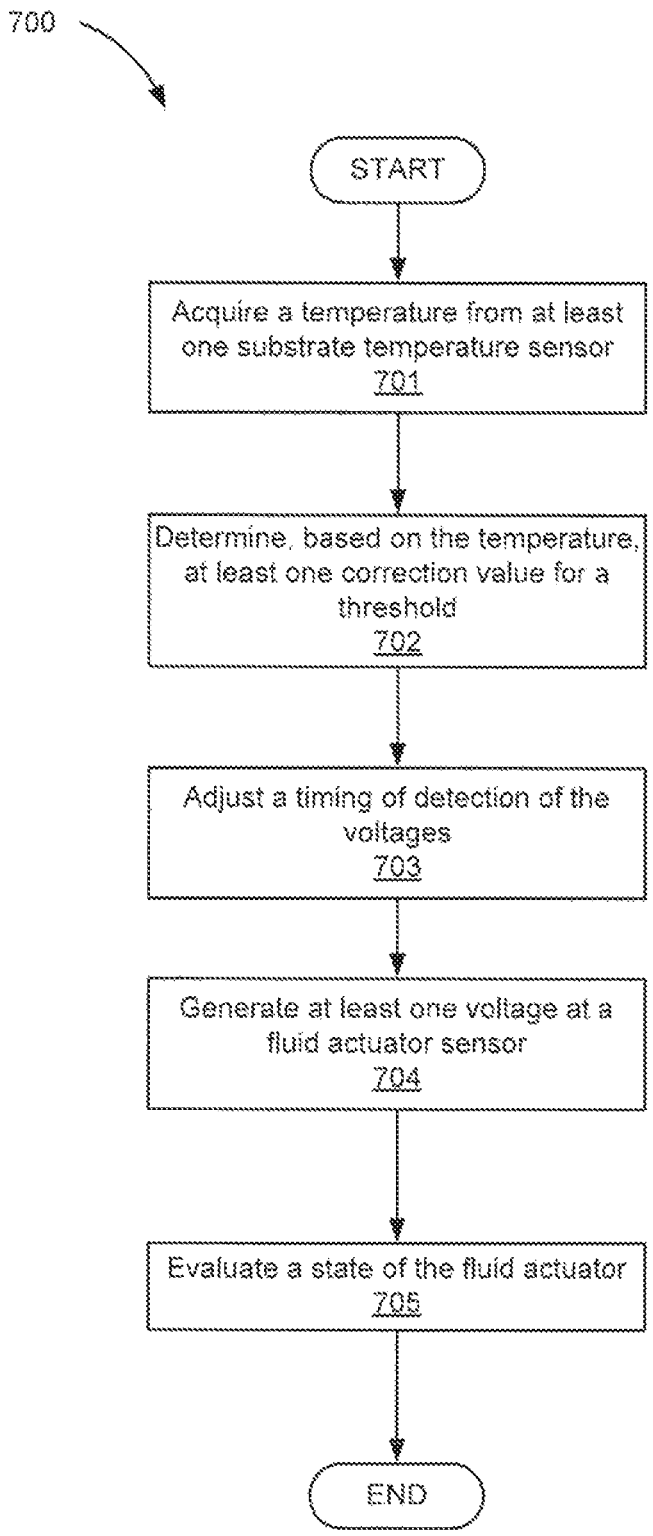
FIG. 7 is a flow chart of a method for evaluating an actuator on a fluidic die based on a temperature of a substrate, according to an example of the principles described herein.

FIG. 7 is a flow chart of a method (700) for evaluating a fluid actuator (FIG. 1, 106) on a fluidic die (FIG. 1 100) based on a temperature of a substrate (FIG. 1, 102), according to an example of the principles described herein. According to the method (700) a temperature is acquired (block 701) and based on the temperature, at least one correction value for a threshold against which output voltages are compared is determined (block 702). This may be done as described above in regards to FIG. 3.

In addition to adjusting the threshold against which the sensed voltages are detected, the temperature may also adjust the timing of detection of those voltages. For example, the altered electrical conductivity of the fluid, in addition to affecting the output voltages, may affect the speed with which drive bubbles form and collapse. Accordingly, a timing of the detection of the voltages may be adjusted (block 703) based on the temperature. That is, the database (FIG. 6, 622) in addition to including a mapping between temperatures and correction values, may include a mapping between temperatures and times at which the sensed voltages should be collected.

Based on this adjusted timing at least one voltage is generated (block 704) at an actuator sensor (FIG. 1, 108) and a state of the fluid actuator evaluated (block 705) accordingly. These may be performed as described above in connection with FIG. 3.

In one example, using such a fluidic die 1) allows for actuator evaluation; 2) provides improved resolution times for malfunctioning actuators; and 3) provides more accurate assessment of actuator health by accounting for die substrate temperatures.

What is claimed is:

1. A fluidic system, comprising:

a fluidic die comprising:

a substrate in which a number of fluid chambers are formed, wherein each fluid chamber comprises a fluid actuator disposed within the fluid chamber; and a number of actuator sensors disposed on the substrate to output at least one value indicative of a sensed characteristic of a fluid actuator;

a number of substrate temperature sensors disposed on the substrate to sense a temperature for the substrate; and an actuator evaluation device to determine a state of the fluid actuator based at least in part on the at least one value and at least one correction value associated with the temperature sensed by the number of substrate temperature sensors.

2. The fluidic system of claim 1, wherein:

the fluid chamber is an ejection chamber; and the fluid actuator is an ejector to eject fluid through an opening in the ejection chamber.

3. The fluidic system of claim 1, wherein the number of substrate temperature sensors is the same as the number of fluid chambers.

4. The fluidic system of claim 1, wherein the number of substrate temperature sensors is less than the number of fluid chambers.

5. The fluidic system of claim 1, wherein the at least one correction value is an adjusted threshold voltage which adjustment is based on the temperature of the substrate.

6. The fluidic system of claim 1, wherein the at least one correction value is stored in a database table which maps temperature to correction values.

7. The fluidic system of claim 6, wherein the database table is generated during at least one of production initialization and product design.

8. The fluidic system of claim 1, wherein the at least one correction value is:

unique to the fluidic die; and based on an architecture of the fluidic die and fluid in the fluidic die.

9. A fluidic system comprising:

multiple fluidic dies, wherein a fluidic die comprises:

a substrate in which a number of fluid chambers are formed, wherein each fluid chamber comprises a fluid actuator disposed within the fluid chamber;

a number of actuator sensors disposed on the substrate to output at least one value indicative of a sensed characteristic of a fluid actuator;

a number of substrate temperature sensors disposed on the substrate to sense a temperature of the substrate; and an actuator evaluation device to determine a state of the fluid actuator based at least in part on the at least one value and at least one correction value which is dependent upon the temperature sensed by the number of substrate temperature sensors.

10. The fluidic system of claim 9, wherein the at least one correction value comprises multiple correction values that independently adjust a peak threshold value and a refill threshold value against which a first voltage and a second voltage are compared as the temperature of the substrate changes.

11. The fluidic system of claim 9, wherein:

an actuator sensor outputs two voltages at two different points in time, wherein the points in time are determined based on the temperature sensed by the number of substrate temperature sensors;

the at least one correction value comprises a correction difference threshold against which a difference between the two voltages is compared; and the actuator evaluation device compares the difference between the two voltages with the correction difference threshold to determine the state of a fluid actuator.

12. A method comprising:

acquiring a temperature of a substrate on which fluid chambers of a fluid die are disposed from at least one substrate temperature sensor;

generating at least one voltage at a fluid actuator sensor responsive to activation of a fluid actuator;

determining; based on the temperature of the substrate, at least one correction value for a threshold value against which the at least one voltage is compared; and evaluating a state of the fluid actuator at an actuator evaluation device based on a comparison of the at least one voltage and a corrected threshold value.

13. The method of claim 12, wherein generating the at least one voltage occurs during a printing operation.

14. The method of claim 12, wherein generating the at least one voltage occurs during a testing phase; independent of a printing operation.

15. The method of claim 12, further comprising adjusting a timing of detection of the at least one voltage.

* * * * *